US005419453A

United States Patent [19]

Lochridge

[11] Patent Number: 5,419,453

[45] Date of Patent: May 30, 1995

[54] TRASH RECEPTACLE WITH BAG RETAINER

[76] Inventor: Jeffrey L. Lochridge, 1175 N. 4000 W., Rexburg, Id. 83440

[21] Appl. No.: 191,522

[22] Filed: Feb. 4, 1994

[51] Int. Cl.[6] ..... B65D 7/04

[52] U.S. Cl. ..... 220/404; 220/908

[58] Field of Search ..... 220/404, 403, 402, 908, 220/625

[56] References Cited

U.S. PATENT DOCUMENTS

| | | | |
|---|---|---|---|
| 3,927,786 | 12/1975 | Aboud | 220/908 X |
| 4,167,271 | 9/1979 | Jorgensen | 220/908 X |
| 4,254,602 | 3/1981 | Boynton | 220/908 X |
| 4,643,380 | 2/1987 | Copeland | 220/908 X |
| 4,664,347 | 5/1987 | Brown et al. | 220/404 X |
| 4,691,841 | 9/1987 | Sussman . | |
| 4,715,572 | 12/1987 | Robbins, III . | |
| 4,765,579 | 8/1988 | Robbins, III . | |
| 4,842,228 | 6/1989 | Kasper | 220/908 X |
| 4,856,675 | 8/1989 | Palazzola . | |
| 4,867,339 | 9/1989 | Hahn | 220/404 |
| 4,867,399 | 9/1989 | Hahn . | |
| 4,892,224 | 1/1990 | Graham . | |
| 4,913,308 | 4/1990 | Culbertson . | |
| 4,925,056 | 5/1990 | McCoig . | |
| 5,028,022 | 7/1991 | Metcalf . | |
| 5,295,606 | 3/1994 | Karwoski | 220/404 X |

FOREIGN PATENT DOCUMENTS 180070 12/1957 Sweden .

*Primary Examiner*—Steven M. Pollard
*Attorney, Agent, or Firm*—Richard C. Litman

[57] ABSTRACT

A trash receptacle for use with a trash bag liner is disclosed. The trash receptacle includes a sleeve, a base member, and latches which secure the base member to the sleeve member. The sleeve member has a open ended box-like body with an upper edge and inversely tapered sidewalls that extend downwardly from the upper edge to terminate in a lower edge. The base member has a floor with a walls extending from the perimeter of the floor to define an enclosed area. The base member has a rectangular cross section conforming to that of the sleeve, allowing the sleeve to rest and fit on the base member. In an alternative embodiment, the cross section of the base member is circular and the sleeve has an inverse, frusto-conical configuration.

7 Claims, 4 Drawing Sheets

FIG. 6
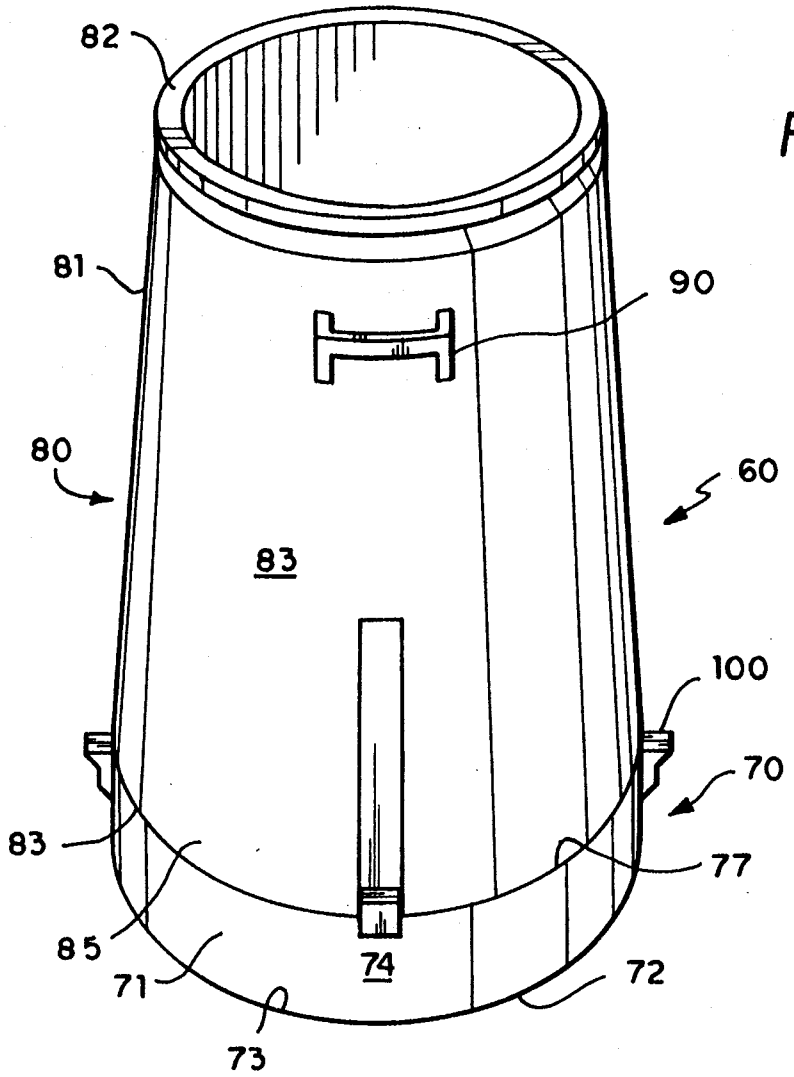
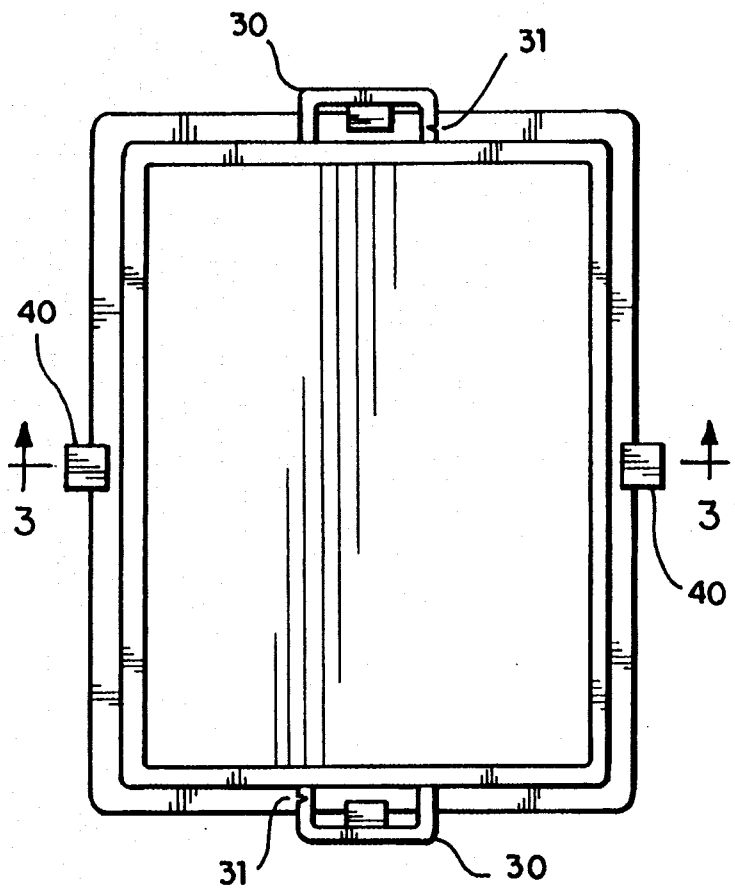
FIG. 5

TRASH RECEPTACLE WITH BAG RETAINER

BACKGROUND OF THE INVENTION

1. Field of the Invention

The present invention relates to the field of trash receptacles and in particular to receptacles that utilize liners.

2. Description of the Prior Art

An unpleasant aspect of daily life, whether at home or at work, is the accumulation of trash. Such accumulation is known to be especially acute in the kitchens of restaurants and other food serving establishments. Trash receptacles of various sizes and shapes are have been used to accumulate waste and are often lined with a disposable liner bag. The liner bags include a mouth or opening and are adapted to be received in the trash receptacle.

There are a number of problems associated with removal of a trash liner bag once it has been packed with trash, particularly for large trash receptacles. A full trash bag liner is often heavy and difficult to remove from the receptacle. The difficulty of removing the full liner is compounded by the vacuum formed in the receptacle as the bag is removed.

Additionally, there are a number of problems associated with cleaning the bottom of a trash receptacle which has been soiled due to leakage of the a liner. The height of a fairly tall trash receptacles make it difficult to thoroughly clean the bottom of the receptacle.

U.S. Pat. No. 4,691,841, issued to Howard Sussman on Sep. 8, 1987, discloses a Container For A Plastic Trash Bag. The container includes a polygonal body with an open top and a cap in the form of an open frame. Although the disclosed container allows for retaining a flexible plastic bag within the container, the disclosed structure fails to provide a convenient means for removal of a full trash bag.

U.S. Pat. Nos. 4,715,572 and 4,765,579, issued to Edward S. Robbins, III et al. on Dec. 29, 1987 and Aug. 23, 1988, respectively, both disclose a Trash Bag Retainer. The disclosed device is attachable to a trash receptacle and provides means for retaining a plastic bag liner in place within the receptacle. The disclosed device also provide a means for venting the air between the bag liner and the sidewalls of the receptacle. However, the disclosed device fails to provide a convenient means of removing a packed trash bag liner.

The following patents all disclose devices that retain plastic trash bag liners within a trash receptacle: U.S. Pat. Nos. 4,856,675, issued to Sam Palazzola on Aug. 15, 1989; U.S. Pat. No. 4,867,339, issued to William N. Hahn on Sep. 19, 1989; U.S. Pat. No. 4,892,224, issued to Donald J. Graham on Jan. 9, 1990; U.S. Pat. No. 4,913,308, issued to Russell D. Culbertson on Apr. 3, 1990; U.S. Pat. No. 4,925,056, issued to James E. McCoig on May 15, 1990; U.S. Pat. No. 5,028,022, issued to James C. Metcalf on Jul. 2, 1991; and Sweden Patent No. 180,070, issued to Johnsson on Dec. 21, 1962.

None of the above inventions and patents, taken either singly or in combination, is seen to describe the instant invention as claimed.

SUMMARY OF THE INVENTION

Accordingly, it is a principal object of the invention to provide a novel trash receptacle design that allows for removal of the upper portion of the receptacle to facilitate easy removal of a trash liner from the receptacle.

It is another object of the invention to provide a trash receptacle design which will allow for easy cleaning of the receptacle once a trash liner is removed.

It is an object of the invention to provide improved elements and arrangements thereof in an apparatus for the purposes described which is inexpensive, dependable and fully effective in accomplishing its intended purposes.

These and other objects of the present invention will become readily apparent upon further review of the following specification and drawings.

A trash receptacle according to the invention is provided having a sleeve member and a base member. The base member includes a floor with walls extending from the perimeter edge of the floor. The walls terminate to a top edge.

The sleeve member has an open top and open bottom body with tapered side walls which define an enclosed area. The side walls of the sleeve have both upper edges and bottom edges. At the bottom edge of the sleeve, the side walls have a cross section conforming to that of the base member. The bottom edge of the sleeve rests upon the top edge of the base.. The sleeve is detachably secured to the base.

With the sleeve attached to the base, a trash bag liner is placed in the receptacle. Once the trash bag liner is packed with trash and tied off, the sleeve is detached from the base and pulled up and over the full bag. The inversely tapered walls of the sleeve allow the sleeve to be easily pulled over a packed trash bag liner. Removal of the sleeve allows the user to lifted the trash bag out of the base and easily disposed of. Once detached from the sleeve, the base of the receptacle may then be cleaned by hand or placed in a dishwasher.

BRIEF DESCRIPTION OF THE DRAWINGS

FIG. 5 is plan view of a trash receptacle;

FIG. 6 is a perspective view of an alternate embodiment of a trash receptacle.

Similar reference characters denote corresponding features consistently throughout the attached drawings.

DETAILED DESCRIPTION OF THE PREFERRED EMBODIMENTS

Figure 1:
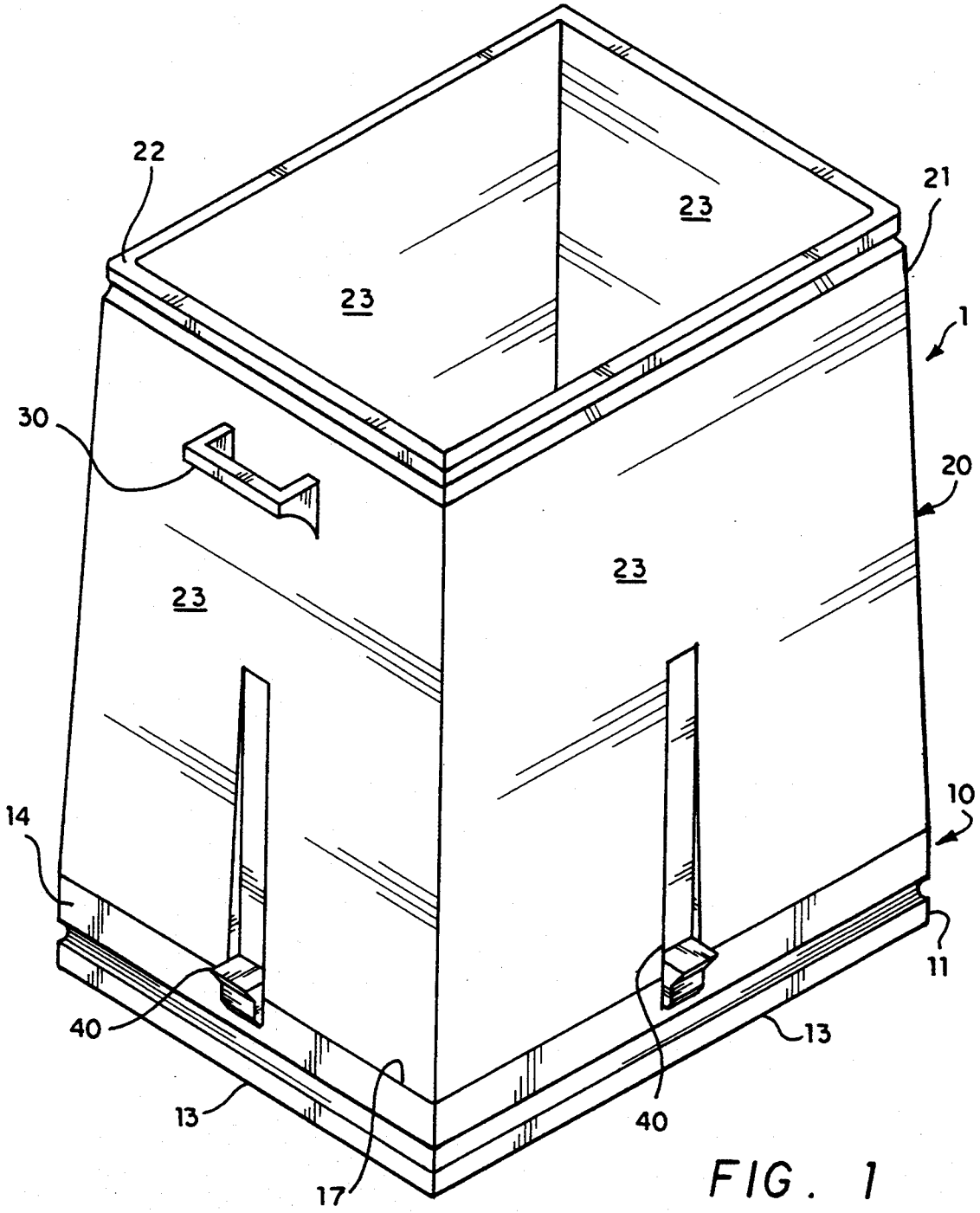
FIG. 1 is a perspective view of a trash receptacle with the sleeve secured to the base.
Figure 2:
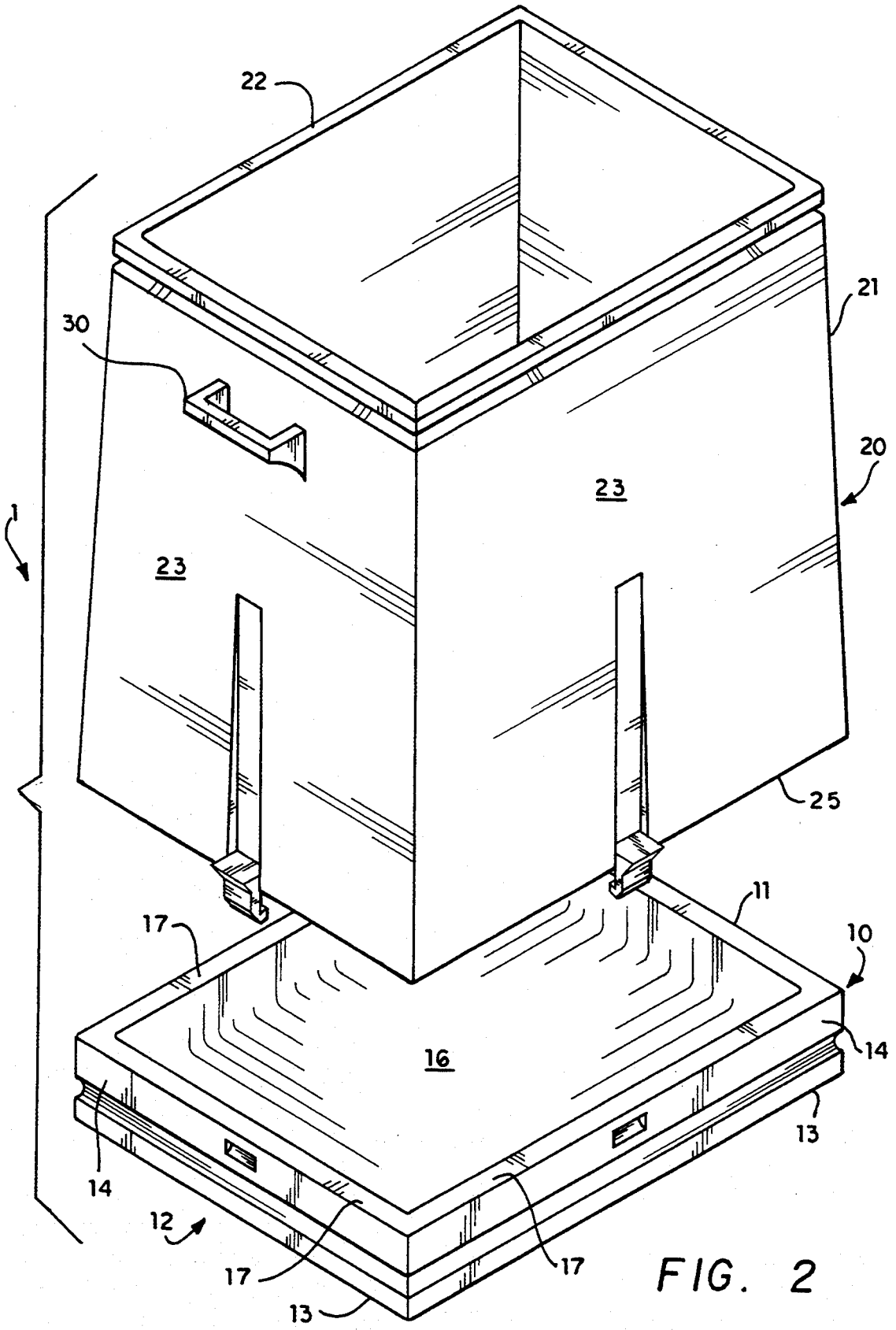
FIG. 2 is a perspective view of a trash receptacle with the with the sleeve detached from the base.

The trash receptacle I of the present invention, as shown in FIG. 1 and FIG. 2, includes a base member 10 and a sleeve 20. The base member 10 has an open topped body 11 made of a plastic material. The body 11 includes a floor 12, four perimeter edges 13, and base walls 14 extending upwardly from each of the four perimeter edges 13. The base walls 14 define an enclosed area 16 having a rectangular cross section. Each of the base walls 14 terminate in a top edge 17. In one preferred embodiment, the base unit has a height of 4 inches, a length of 20 inches and a width of 26 inches.

Figure 3:
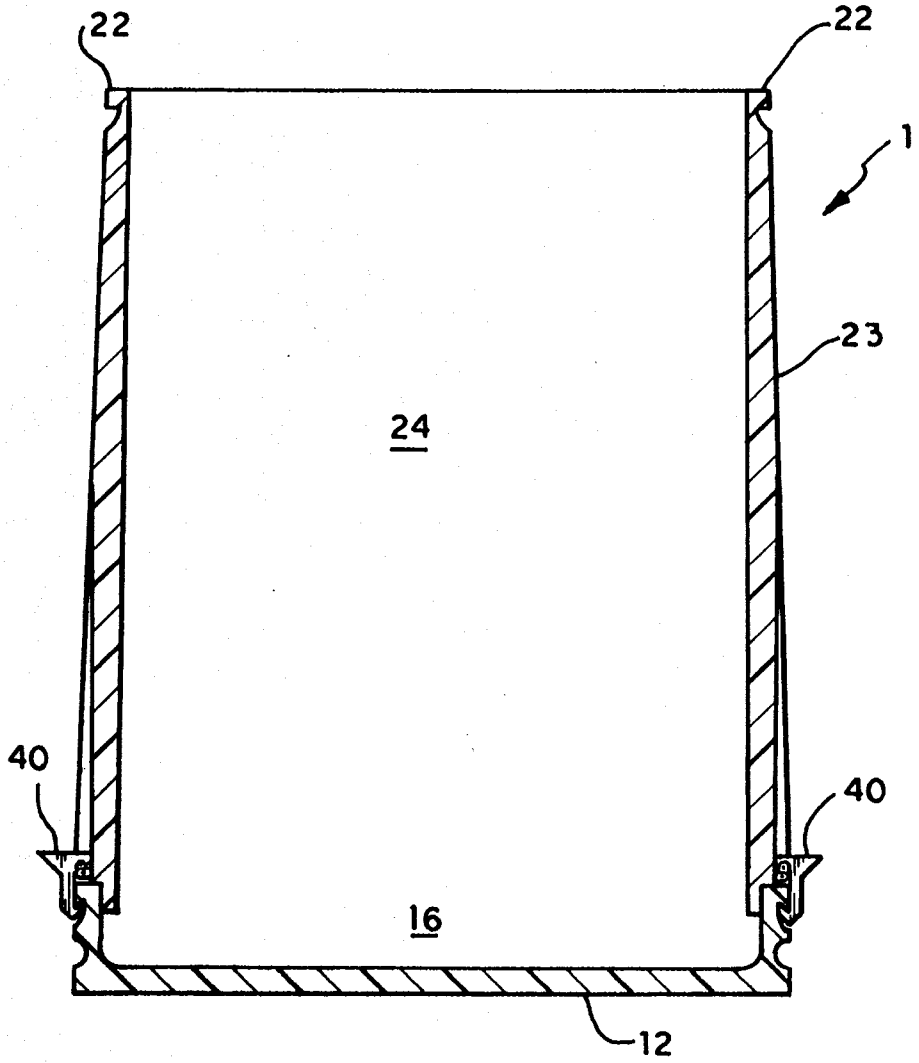
FIG. 3 is a view in section of the receptacle taken along the line 3—3 in FIG. 5.

As shown in FIG. 2 and FIG. 3, the sleeve 20 has an open top and open bottom body 21 made of a plastic material. The body has an upper edge 22 with inversely tapered side walls 23 extending downwardly from the upper edge 22 to define an enclosed area The tapered side walls 23 allow the sleeve 20 to be easily pulled over a packed trash bag liner. The side walls 23 terminate in a bottom edge 25 which is arranged in conforming cross section to that of the top edge 17 of the base member 10. The bottom edge 25 of the sleeve 20 rests on the top edge 17 of the base member 10. As shown in FIG. 5, two handles 30 may be attached to the sleeve. The handles 30 are attached to opposing side walls 23 of the sleeve 20. Each of the handles 30 may include a slot 31 to facilitate retention of a trash bag liner within the receptacle 1. In one preferred embodiment, the following dimensions are appropriate. The side walls 23 of the sleeve have a height of approximately 30 inches. The upper edge 22 of the sleeve 20 has a rectangular cross section measuring 18 inches in width and 24 inches in length. The bottom edge 25 of the sleeve 20 has a rectangular cross section measuring 20 inches in width and 26 inches in length.

Figure 4:
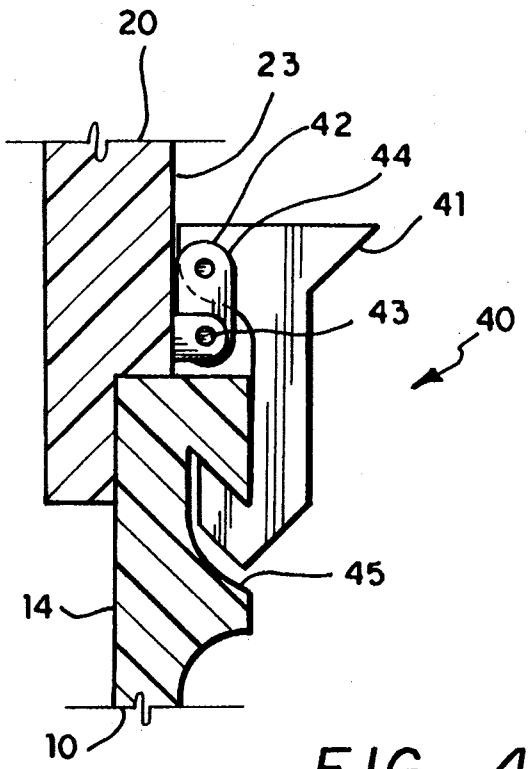
FIG. 4 is an enlarged scale, fragmentary cross-sectional view showing the latching mechanism for the receptacle.

The sleeve 20 is secured to the base member 10 by four latching mechanisms 40. As shown in FIG. 4, latching mechanism 40 includes a hook member 41, and a pivot arm 42. The pivot arm 42 has a first end 43 and a second end 44, with the first end 43 pivotally attached to the a side wall 23 of the sleeve 10. The pivot arm 42 is attached to the side wall 23 near the bottom edge 25 of the sleeve 10. The second end 44 of the pivot arm 42 is pivotally connected to the hook member 41. The hook member 41 fits into a depression 45 formed in the base wall 14 of the base member 10 and secures the sleeve member 20 to the base member 10.

An alternative embodiment of the trash receptacle 60 is shown in FIG. 6. The alternate embodiment is made up of a base member 70 and a sleeve 80. The base member 70 has an open topped body 71 made of a plastic material. The body 71 includes a floor 72, a perimeter edge 73, and a base wall 74 extending upwardly from the perimeter edge 73. The base wall 74 defines an enclosed area having a circular cross section. The base wall 74 terminates in a top edge 77. The base unit may have a height of 4 inches, and a cross sectional diameter of 20 inches.

The sleeve 80 has an open top and open bottom body 81 made of a plastic material. The body 81 has an upper edge 82 with inversely tapered side walls 83 extending downwardly from the upper edge 82 to define an enclosed area having a circular cross section. The tapered side walls 83 allow the sleeve 80 to be easily pulled over a packed trash bag liner. The side walls 83 terminate in a bottom edge 85 which is arranged in conforming cross section to that of the top edge 77 of the base member 70. The bottom edge 85 of the sleeve 80 rests on the top edge 77 of the base member 70. Handles 90 may be attached to the sleeve 80. The handles 90 of the alternative embodiment 60 are identical in structure to the handles 30 of the preferred embodiment 1. The side walls 83 of the sleeve may have a height of approximately 30 inches, and the upper edge 82 of the sleeve 80 may have a circular cross section measuring 18 inches in diameter. The bottom edge 85 of the sleeve 80 has a circular cross section measuring 20 inches in diameter. The sleeve 80 is secured to the base member 70 by four latching mechanisms 100.

It is to be understood that the present invention is limited to neither the preferred embodiment nor the alternative embodiment described above, but encompasses any and all embodiments within the scope of the following claims.

I claim:

1. A trash receptacle for use with a trash bag liner comprising:

a base member, said base member comprising a open topped body having a floor, a perimeter edge, and a base wall extending upwardly from said perimeter edge of said floor, said base wall terminating in a top edge;

a sleeve, said sleeve comprising a open top and open bottom body having an upper edge, inversely tapered side wall means extending downwardly from said upper edge to define an enclosed area, said side wall means terminating in a bottom edge, said bottom edge configured in conforming cross section to said top edge of said base member and adapted to fit on top of said base member, said sleeve having a handle means for lifting said sleeve from said base member;

a pivot arm having a first end and a second end, said second end being pivotally attached to said side wall means of said sleeve;

said base wall of said base member having a depression; and a hook member securing said sleeve to said base member by engaging said depression, said hook member includes a hook base and a hook end for engaging said depression, said hook base is pivotally attached to said first end of said pivot arm, wherein said pivot arm permits said hook end to slide over said top edge of said base member.

2. The trash receptacle according to claim 1, wherein said securing means comprises a latch.

3. The trash receptacle of claim 2, further comprising means for retaining the trash bag liner within said trash receptacle.

4. The trash receptacle of claim 1, said sleeve having an inverse, frusto-conical configuration.

5. A trash receptacle for use with a trash bag liner comprising:

a base member, said base member including a open top body having a floor, four perimeter edges, base walls extending upwardly from each of said four perimeter edges of said floor to define an area having a rectangular cross section, each of said base walls terminating in a top edge, and a depression formed in said base walls;

a sleeve, said sleeve comprising a open top and open bottom body having an upper edge, inversely side walls extending downwardly from said upper edge to define an enclosed area, said side walls terminating in a bottom edge, said bottom edge arranged in conforming cross section to said top edge of said base member and adapted to fit on top of said base member;

a first and second handle, said first handle attached to one of said four tapered side walls of said sleeve, said second handle attached to another of said four tapered side walls opposite said first handle, said first handle and said second handle having a first lateral side, a second lateral side opposite said first lateral side, and a first slot on said first lateral side of said first handle and a second slot on said second lateral side of said second handle, wherein said first and second slots retain the trash bag liner within said receptacle;

a pivot arm having a first end and a second end, said second end being pivotally attached to said side wall of said sleeve; and a hook member securing said sleeve to said base member by engaging said depression, said hook member includes a hook base and a hook end for engaging said depression, said hook base is pivotally attached to said first end of said pivot arm, wherein said pivot arm permits said hook end to slide over said top edge of said base member.

6. A trash receptacle for use with a trash bag liner comprising:

a base member, said base member including a open top body having a floor, a perimeter edge, a base wall extending from said perimeter edge to define an area having a circular cross section, said base wall terminating in a top edge, and a depression formed along said base wall;

a sleeve, said sleeve comprising a open top and open bottom body having an upper edge, inversely tapered side walls extending downwardly from said upper edge to define an enclosed area, said side walls terminating in a bottom edge, said bottom edge arranged in conforming cross section to said top edge of said base member and adapted to fit on top of said base member;

a plurality of handles;

a pivot arm having a first end and a second end, said second end being pivotally attached to said side wall of said sleeve; and a hook member securing said sleeve to said base member by engaging said depression, said hook member includes a hook base and a hook end for engaging said depression, said hook base is pivotally attached to said first end of said pivot arm, wherein said pivot arm permits said hook end to slide over said top edge of said base member.

7. The trash receptacle of claim 6, wherein each of said handles includes means for retaining the trash bag liner within said receptacle.

* * * * *